US006726016B2

(12) United States Patent
Chen

(10) Patent No.: US 6,726,016 B2
(45) Date of Patent: Apr. 27, 2004

(54) CONTAINER ASSEMBLY FOR PERFUME BOTTLES

(76) Inventor: Sin-Hsiung Chen, No. 140, Cheng-Pei 1st Rd., Yung-Kang City, Tainan Hsien (TW)

( * ) Notice: Subject to any disclaimer, the term of this patent is extended or adjusted under 35 U.S.C. 154(b) by 82 days.

(21) Appl. No.: 10/040,467

(22) Filed: Jan. 9, 2002

(65) Prior Publication Data

US 2003/0127354 A1 Jul. 10, 2003

(51) Int. Cl.[7] ..... B65D 69/00; B65D 88/54; B67D 5/06

(52) U.S. Cl. ..... 206/581; 206/823; 222/183; 222/321.7

(58) Field of Search ..... 206/581, 823, 206/736, 756, 758, 385; 220/23.4, 23.83; 222/129, 143, 144, 183, 321.7, 135

(56) References Cited

U.S. PATENT DOCUMENTS 2,825,085 A * 3/1958 Ingraham ..... 220/23.4
3,194,426 A * 7/1965 Brown, Jr. ..... 222/143
D311,787 S * 10/1990 Cassai et al. ..... D28/77
D337,178 S * 7/1993 Cassai ..... D28/77
D338,741 S * 8/1993 Cassai ..... D28/77
5,356,040 A * 10/1994 Reggiani ..... 222/129
D399,059 S * 10/1998 Holmgren et al. ..... D3/316
6,230,889 B1 * 5/2001 Chen ..... 206/446

* cited by examiner

*Primary Examiner*—Mickey Yu
*Assistant Examiner*—Gregory Pickett

(57) ABSTRACT

A container assembly of a perfume bottle includes two oppositely and reversedly combined container bodies, two junction plates respectively mounted to the container bodies, and two caps respectively covered on the container bodies. The perfume bottles can be placed in the container bodies with their nozzles aligned to the nozzle holes of the container bodies. The two container bodies can be pushed to slide in reverse directions to expose their nozzle holes and the nozzles of the perfume bottles, thus, facilitating the perfume to be sprayed out of the saddle heads of the perfume bottles when the caps are pressed downwards. The container assembly for perfume bottles is designed to accommodate different perfume bottles therein, convenient in use and carry, quick to be opened and closed, and provided with a delicate and elegant appearance.

3 Claims, 6 Drawing Sheets

CONTAINER ASSEMBLY FOR PERFUME BOTTLES

BACKGROUND OF THE INVENTION

1. Field of the Invention

This invention relates to a container of perfume bottles, particularly to one suitable to different perfume bottles to be inserted therein, convenient in use and carry, quick to be opened and closed, and provided with a delicate and elegant 2. Description of the Prior Art Generally, a known conventional perfume bottle 1 has a nozzle 10 disposed on: the bottle body and a cap 11 covered thereon, as shown in FIG. 1. In operation, the cap 11 is taken off, and then the nozzle 10 is pressed downwards to spray perfume from the bottle body. However, in practice the conventional perfume bottle 1 has the following disadvantages.

2. It is difficult to close the cap 11 tightly so that the perfume disposed in the bottle body is liable to leak out. This is very inconvenient in use.

2. The cap 11 has to be covered on the nozzle 10 exactly aligned to the bottle body; otherwise, the cap 11 is easy to escape from the bottle body, which is very inconvenient, in use.

3. The cap 11 and the bottle body are put together by combining two separate articles so that the cap 11 is easy to fall or lose. The perfume bottle 1 without the cap 11 is hard to be placed properly and is unable to stop the perfume to leak out or prevent the nozzle 10 from being polluted to influence the quality and the scent of the perfume.

SUMMARY OF THE INVENTION

The main purpose of the invention is to offer a container assembly of a perfume bottle suitable for different perfume bottles installed therein, convenient in use and carry, and quick to be opened and closed.

To achieve about object, the present invention provides a container assembly of a perfun3 bottle includes two oppositely arranged container bodies, two junction plates respectively mounted to the container bodies, and two caps respectively covered on the container bodies. The perfume bottles can be placed in the container bodies with their nozzles aligned to the nozzle holes of the container bodies. The two container bodies can be pushed to slide in reverse directions to expose their nozzle holes and the nozzles of the perfume bottles, thus facilitating the perfume to be sprayed out of the saddle heads of the perfume bottles when the caps are pressed downwards. The container assembly for perfume bottles is designed to accommodate different perfume bottles therein, convenient in use and carry, quick to be opened and closed, and provided with a delicate and elegant appearance.

BRIEF DESCRIPTION OF DRAWINGS

This invention will be better understood by referring to the accompanying drawings, wherein.

DETAILED DESCRIPTION OF THE PREFERRED

Embodiment

Figure 1:
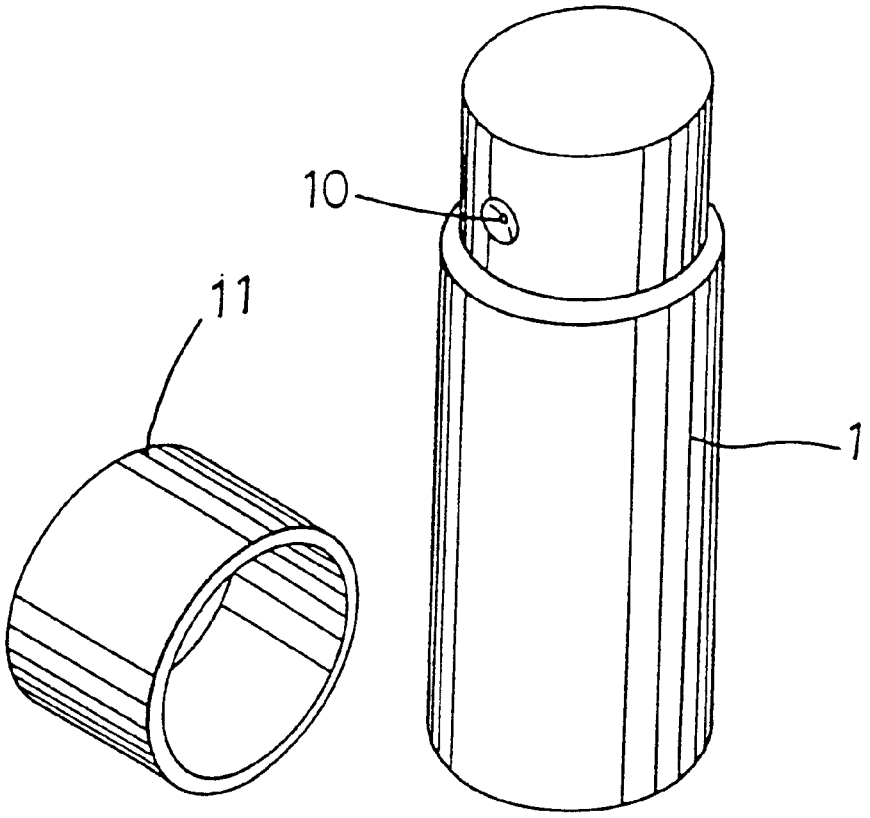
FIG.1 (PRIOR ART)
FIG. 1 is a schematic view showing the construction of a conventional perfume bottle.
Figure 2:
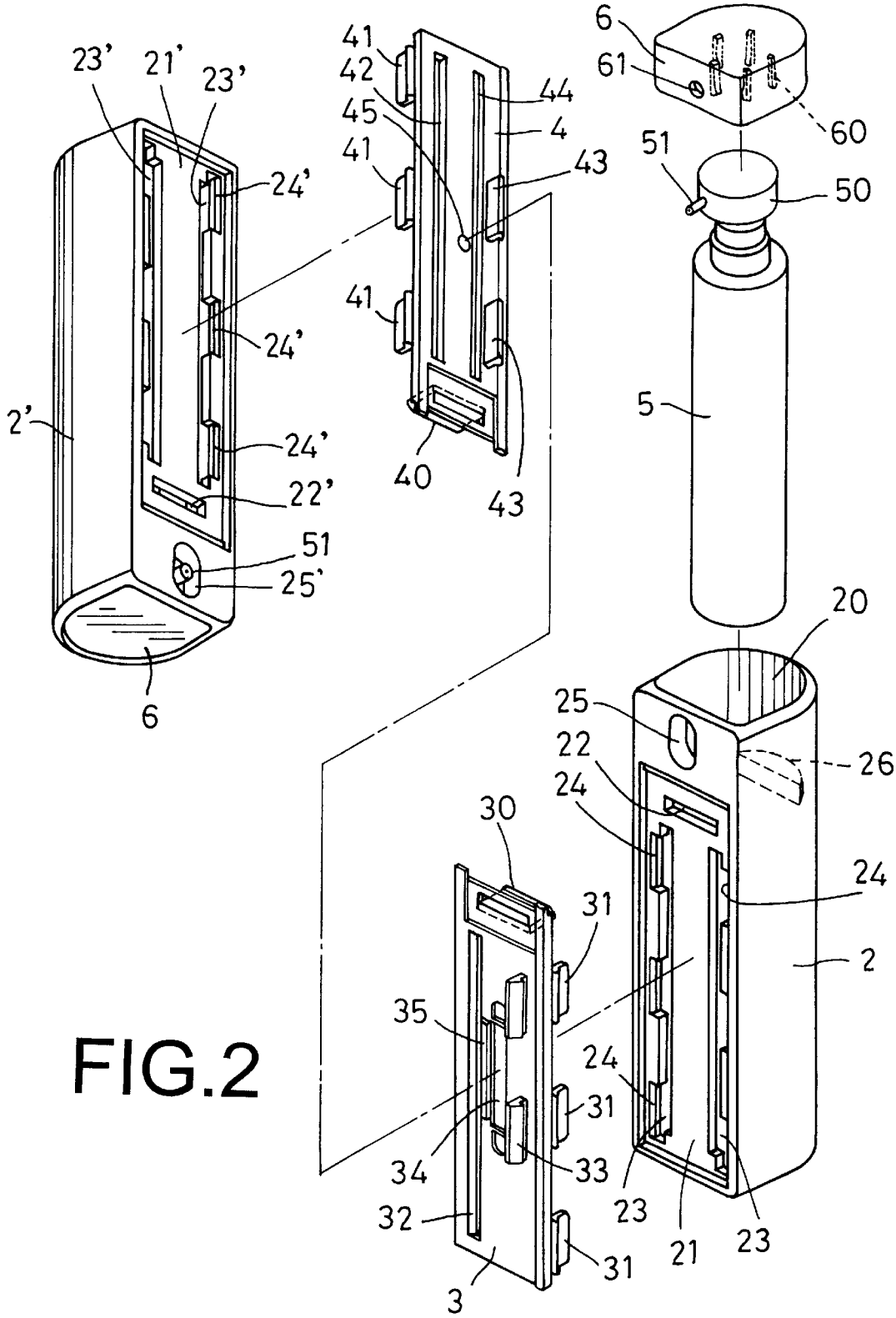
FIG. 2 is an exploded perspective view showing the construction of a container of a perfume bottle according to the present invention.

A preferred embodiment of a container of a perfume bottles of the present invention, as shown in FIG. 2, mainly includes two oppositely arranged container bodies 2, 2', a first junction plate 3, a second junction plate 4, at least one perfume bottle 5 and two caps 6.

The two oppositely and reversedly combined container bodies 2, 2' are respectively defined as a first container body 2 and a second container body 2'. The first container body 2 has a chamber 20 formed in a hollow portion therein, a concave recess 21 disposed at one side thereof, and a nozzle hole 25 with a tapered bore disposed at an upper portion thereof. The concave recess 21 has a rectangular slot 22 horizontally disposed proximate an upper portion of the concave recess 21, two elongated slots 23 disposed at both sides, and a plurality of engagement grooves 24 disposed at outer surfaces of the two elongated slots 23. A stop block 26 is disposed in an appropriate position of an inner wall of the chamber 20 of the first container body 2. Identical to the first container body 2, the second container body 2' has a chamber 20' (see FIG. 3) formed in a hollow portion therein, a concave recess 21' disposed at one side, and a nozzle hole 25' with a tapered bore disposed at an upper portion. The concave recess 21' has a rectangular insert slot 22' transversally disposed near a lower side of the second container body 2', two elongated slots 23' disposed at both sides, and a plurality of engagement grooves 24' disposed at outer surfaces of the two elongated slots 23'. A stop block 26' (see FIG. 3)) is protruded from an inner wall of the chamber 20' of the second container body 2'.

The first junction plate 3 is mounted to the first container body 2 and is attached to the concave recess 21 of the first container body 2. The first junction plate 3 has an elongated slide slot 32 disposed near one side thereof; an insert plate 30 disposed on a rear surface thereof for being inserted into and engaged in the insert slot 22 of the concave recess 21 of the first container body 2, a plurality of engagement members 31 disposed at both sides of the rear surface for being inserted into and engaged in the plurality of engagement grooves 24 of the first container body 2, at least one engagement block 33 protruded at the other side of a front surface thereof and opposite to the slide slot 32, a slide groove 34 depressed in a predetermined position of the front face, and a slide block 35 protruded in a predetermined position of the front surface.

The first junction plate 3 is mounted to the first container body 2 and is attached to the concave recess 21 of the first container body 2. The first junction plate 3 has an elongated slide slot 32 disposed near one side thereof, an insert plate 30 disposed on a rear surface thereof for being inserted into and engaged in the insert slot 22 of the concave recess 21 of the first container body 2, a plurality of engagement members 31 disposed at both sides of the rear surface for being inserted into and engaged in the plurality of engagement grooves 24 of the first container body 2, at least one engagement block 33 protruded at the other side of a front surface thereof and opposite to the slide slot 32, a slide groove 34 depressed in a predetermined position of the front face, and a slide block 35 protruded in a predetermined position of the front surface.

The second junction plate 4 is capable of being mounted to the second container body 2' and tightly adhered to the concave recess 21' of the second container body 2'. The second junction, plate 4 has an elongated slide slot 42 disposed near one side thereof for being inserted by the at least one engagement block 33 of the first junction plate 3, an insert plate 40 disposed on a rear surface thereof for being inserted into and engaged in the insert slot 22' of the concave recess 21' of the second container body 2', a plurality of engagement members 41 disposed at both sides of the rear surface for corresponding inserted into and engaged in the plurality of engagement grooves 24' of the second container body 2', at least one engagement block 43 protruded at the other side of a front surface thereof opposite to the slide slot 42 for being inserted into and engaged in the slide slot 32 of the first junction plate 3, a slide groove 44 depressed in a predetermined position of the front surface for being fitted by the slide block 35 of the first junction plate 3, and a ball 45 disposed at a predetermined position of the front surface for being fitted into the slide groove 34 of the first junction plate 3.

The at least one perfume bottle 5 can be placed in the chambers 20, 20' of the first and the second container bodies 2, 2'. The perfume bottles 5 has a saddle head 50 disposed at an upper portion and, provided with a nozzle 51 disposed at one side thereof. The nozzle 51 can be located in one of the nozzle holes 25, 25'of the first and the second container bodies 2, 2' respectively.

The two caps 6 can cover the saddle heads 50 of the perfume bottles 5 and fitted in upper portions of the chambers 20, 20' of the first and the second container bodies 2, 2'. Each of the two caps 6 has a plurality of positioning ribs 60 protruded therein, for securing a respective one of the saddle heads 50 of the perfume bottles 5, and an eyelet 61 disposed at one side thereof. The eyelet 61 can be aligned to, a respective one of the nozzles 51 of the perfume bottles 5 and a respective one of the nozzle holes 25, 25'of the first and the second container bodies 2, 2'.

Figure 3:
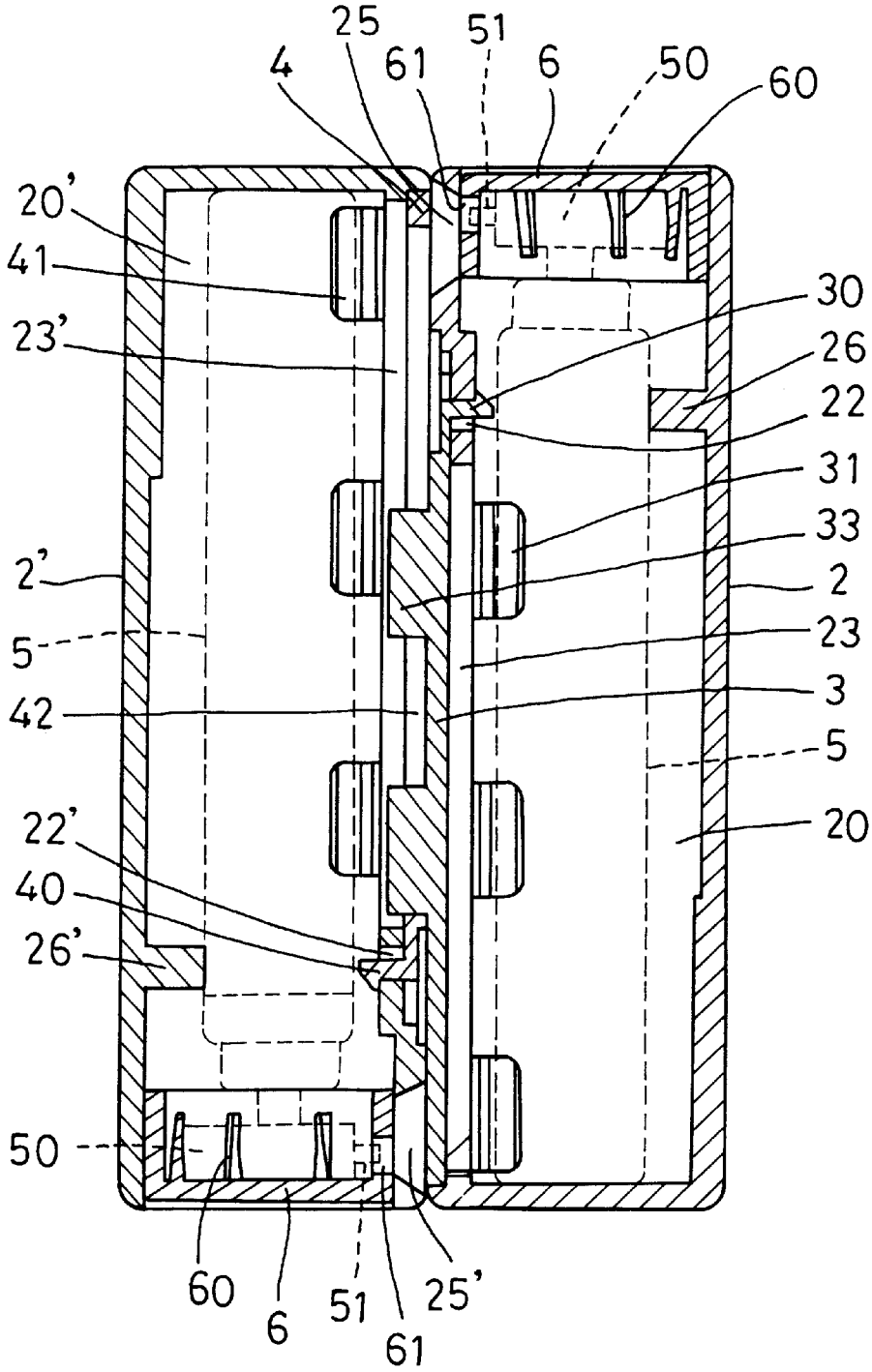
FIG. 3 is a cross-sectional view of the container of the present invention showing the assembly of the present invention.
Figure 4:
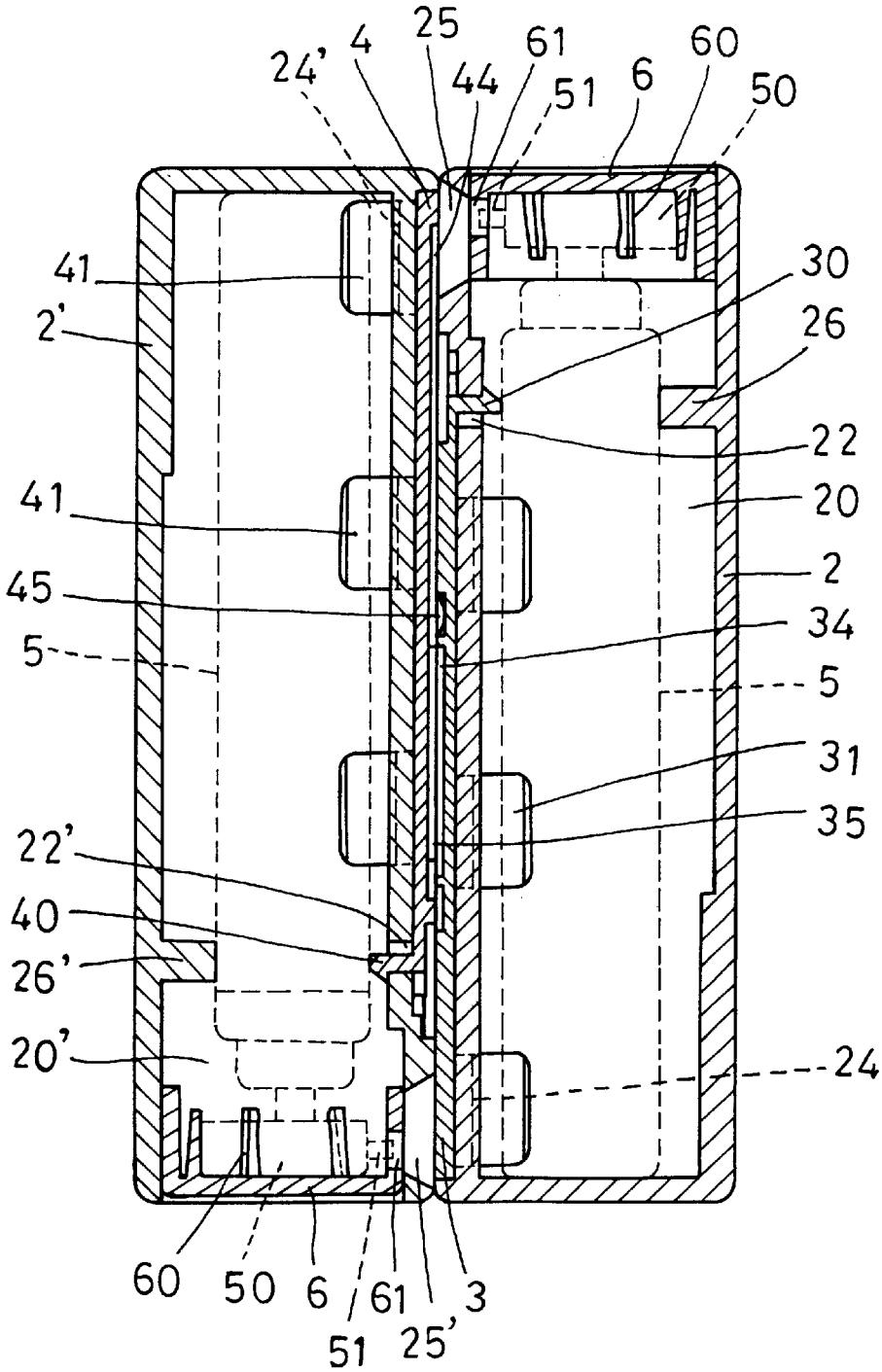
FIG. 4 is a cross-sectional view the container of the present invention, showing another assembly of the present invention.

In assembling, referring to FIGS. 2 to 6, firstly the first junction plate 3 is mounted to the first container body 2. That is: the insert plate 30 disposed on the rear surface of the first junction plate 3 is inserted into and engaged in the insert slot 22 of the concave recess 21 of the first container body 2, and the plurality of engagement members 31 disposed at both sides of the rear face of the first junction plate 3 are inserted into and engaged in the plurality of engagement grooves 24 of the first container body 2, as shown in FIGS. 3 and 4, so that the first junction plate 3 is tightly attached to the concave recess 21 of the first container body 2.

Then, the second junction plate 4 is mounted to the second container body 2'. That is, the insert plate 40 disposed on the rear face of the second junction plate 4 is inserted into and engaged in the insert slot 22' of the concave recess 21' of the second container body 2', and the plurality of engagement members 41 disposed at both sides of the rear face of the second junction plate 4 are inserted into and engaged in the plurality of engagement grooves 24' of the second container body 2' so that the second junction plate 4 is tightly attached to the concave recess 21' of the second container body 2'.

Then, the first and the second container bodies 2, 2' are combined together. That is, the two sides of the two container bodies 2, 2' respectively attached with the first junction plate 3 and the second junction plate 4 are oppositely and reversedly combined together. The at least one engagement block 33 of the first junction plate 3 is inserted into and engaged in the rectangular slide slot 42 of the second junction plate 4, as shown in FIG. 3, and the at least one engagement block 43 of the second junction plate 4 is inserted into and engaged in the slide slot 32 of the first junction plate 3 so that the slide groove 44 of the second junction plate 4 is fitted by the slide block 35 of the first junction plate 3, and the ball 45 of the second junction plate 4 is fitted into the slide groove 34 of the first junction plate 3, as shown in FIG. 4. Thereby, the first and the second container bodies 2, 2' are combined together to be an integral body and allowed to slide in reverse directions when the at least one engagement block 33 is engaged to the rectangular slide slot 42 and the at least one engagement block 43 is engaged to the slide slot 32, and when the slide block 35 is loosely fitted to the slide groove 44 and the ball 45 is loosely fitted to the slide groove 34, as shown in, FIG. 5.

Finally, the two perfume bottles 5 are placed respectively into the chambers 20, 20' of the first and the second container bodies 2, 2', and then the two perfume bottles 5 are covered by the two caps 6. In that, the nozzles 51 of the two perfume bottles 5 are located in the nozzle holes 25, 25' of the first and the second container bodies 2, 2', respectively, and the eyelets 61 of the two caps 6 are aligned to the nozzles 51 of the two perfume bottles 5 and the nozzle hole 25, 25' of the first and the second container bodies 2, 2'. Thereby, the container of the present invention is assembled, as shown in FIG. 6.

Figure 5:
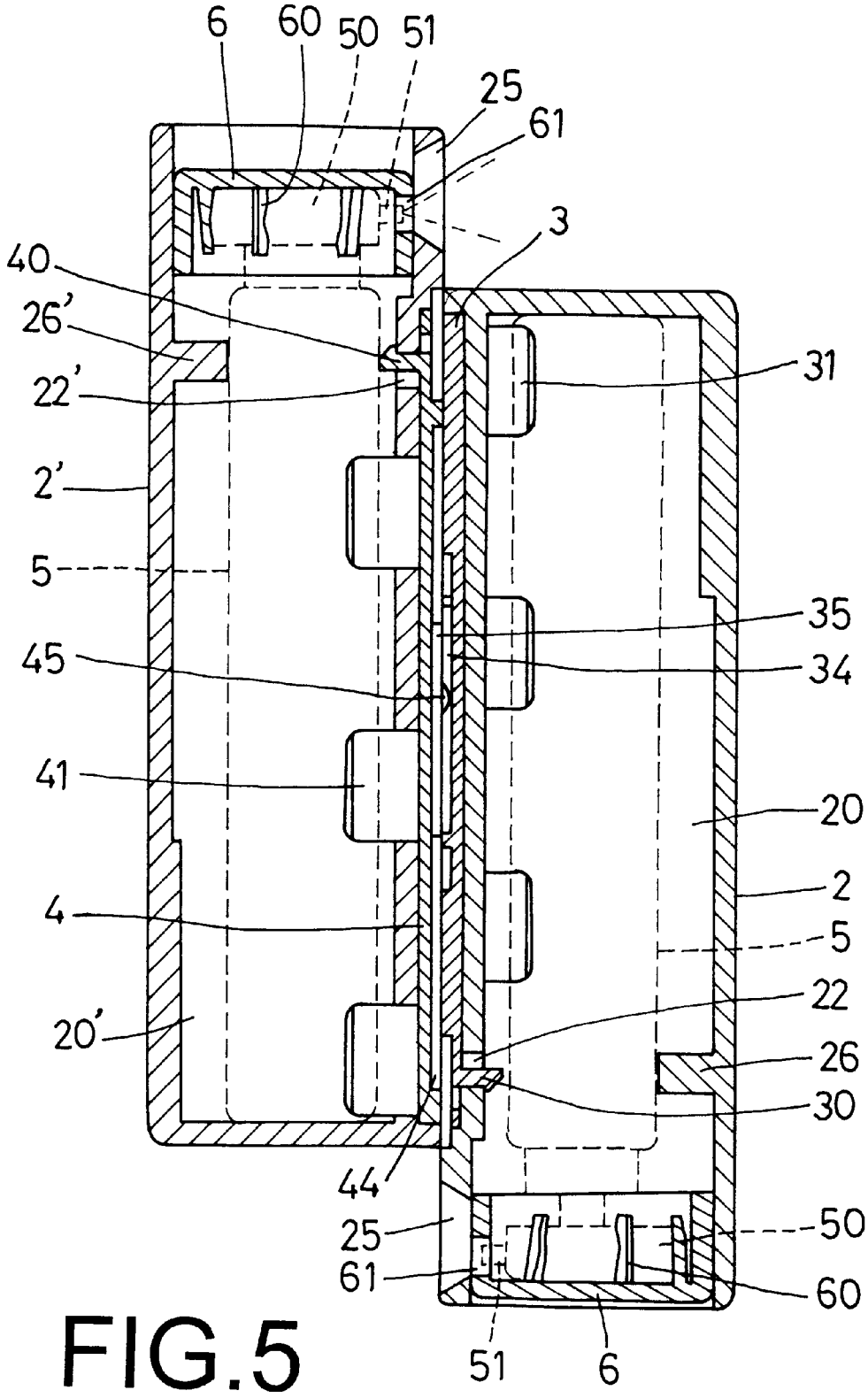
FIG. 5 is a schematic view showing the operation of the contain of a perfume bottle according to the present invention; and, FIG. 6 is a perspective view showing another operation of the container of a perfume bottle of the present invention.
Figure 6:
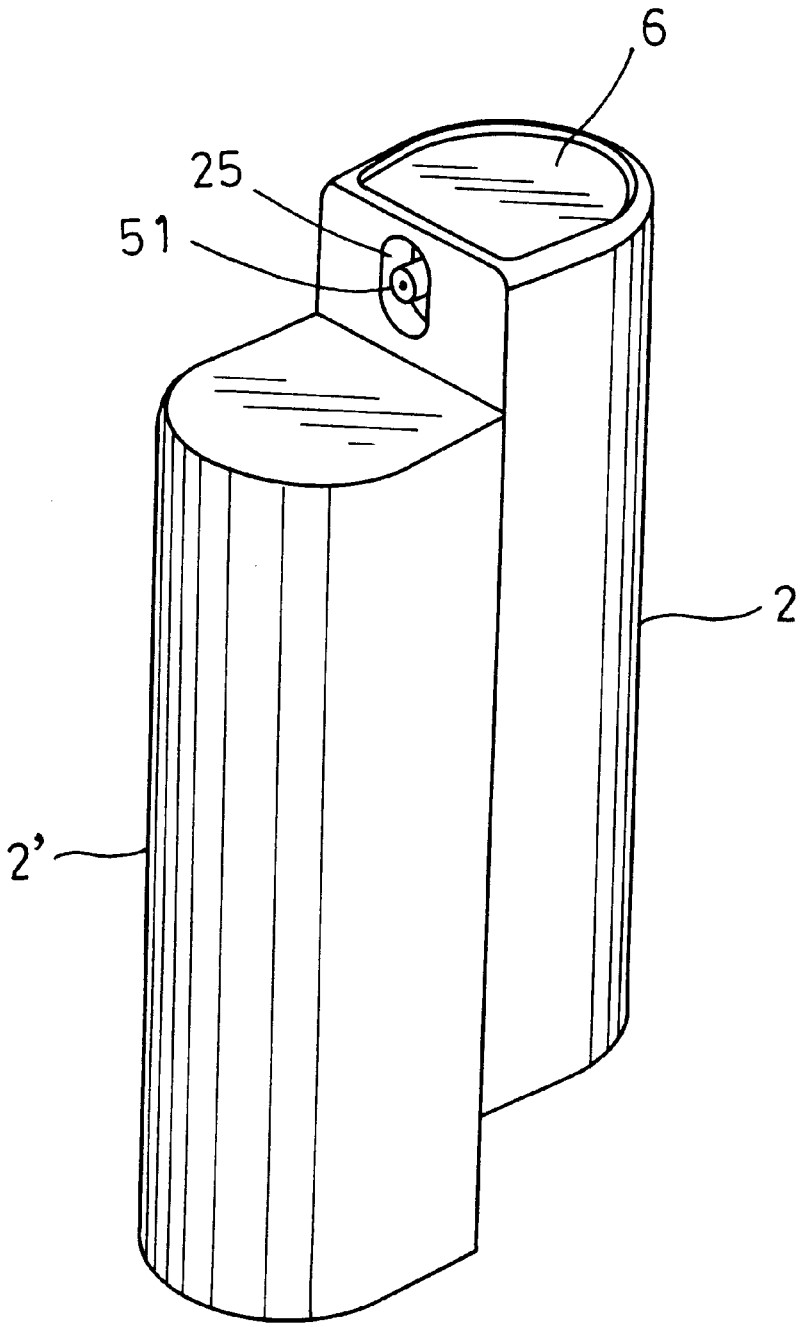

In using, referring, to FIGS. 5 and 6, firstly the first and the second container bodies 2, 2' is pushed to slide in reverse directions by the engagements of the at least one engagement block 33 and the rectangular slide slot 42 and the engagement of the at least one engagement block 43 and the slide slot 32, and the loose fit-in relationships of the slide block 35 and the slide groove 44 and of the ball 45 and the slide groove 34. Thereby, the at least one engagement block 33 and the at least one engagement block 43 slide within the rectangular slide slot 42 and the slide slot 32 and the slide block 35 and the ball 45 slide within the slide groove 44 and the slide groove 34. In such application, the nozzle holes 25, 25' of the first and the second container bodies 2, 2' and the nozzles 51 of the perfume bottles 5 can be exposed, thus facilitating the perfume to be sprayed out of one of the saddle heads 50 of the perfume bottles 5 when a related cap 6 is pressed downwards, as shown in FIG. 5. When closing the container of she present invention, it is only necessary to push the first and the second container bodies 2, 2' back to their initial positions.

The invention has the following advantages and effects, as can be understood from the aforesaid description.

1. The caps of the present invention are capable of being covered firmly.

2. The whole construction of the-present invention is compact, practical, portable and convenient to use.

3. The present invention is capable of rapidly exchanging different perfume bottles easily and simply.

4. The present invention is designed to accommodate different perfume bottles therein, convenient in use and carry, quick to be opened and closed.

While the preferred embodiment of the invention has been described above, it will be recognized and understood that various modifications may be made therein and the appended claims are intended to cover all such modifications that may fall within the spirit and scope of the invention.

What is claimed is:

1. A container assembly for perfume bottles comprising:

two oppositely and reversedly combined container bodies, respectively defined as a first container body and a second container body, each of said two container bodies having a chamber disposed therein, a concave recess disposed at one side and a nozzle hole disposed at an upper portion, said concave recess having an insert slot disposed at an upper portion and a plurality of engagement grooves disposed at both sides;

a first junction plate capable of being mounted to said first container body with a tight attachment to said concave recess of said first container body, said first junction plate having a slide slot disposed proximate one side, an insert plate disposed on a rear face thereof for being correspondingly inserted into and engaged in said insert slot of said concave recess of said first container body, a plurality of engagement members disposed at both sides of said rear face for being correspondingly inserted into and engaged in said plurality of engagement grooves of said first container body in position, at least one engagement block protruded at the other side of a front face thereof opposite to said slide slot of said first junction plate, a slide groove depressed in a predetermined position of said front face, and a slide block protruded in a predetermined position of said front face;

a second junction plate capable of being mounted to said second container body with a tight attachment to said concave recess of said second container body, said second junction plate having a slide slot disposed proximate one side for being inserted by said at least one engagement block of said first junction plate, an insert plate disposed on a rear face thereof for being correspondingly inserted into and engaged in said insert slot of said concave recess of said second container body, a plurality of engagement members disposed at both sides of said rear face for being corresponding inserted into and engaged in said plurality of engagement grooves of said second container body, at least one engagement block protruded at the other side of a front face thereof opposite to said slide slot of said second junction plate for being correspondingly inserted into and engaged in said slide slot of said first junction plate, a slide groove depressed in a predetermined position of said front face for being correspondingly fitted by said slide block of said first junction plate, and a ball disposed adjacent said slide groove of said second junction plate for being correspondingly fitted into said slide groove of said first junction plate;

at least one perfume bottle capable of being respectively placed in said chambers of said two container bodies, each of said perfume bottles having a saddle head disposed at an upper portion and provided with a nozzle disposed at one side thereof for corresponding in location to said nozzle hole of each of said two container bodies; and, two caps capable of respectively covering said saddle heads of said perfume bottles, each of said two caps having an eyelet disposed at one side thereof for being aligned to said nozzle of each of said perfume bottles and said nozzle hole of each of said two container bodies.

2. The container assembly for perfume bottles as claimed in claim 1, wherein two symmetrical elongated slots are respectively disposed at both sides of said concave recess of each of said two container bodies.

3. The container assembly for perfume bottles as claimed in claim 1, wherein a plurality of positioning ribs are disposed on an inner wall of each of said two caps for correspondingly securing said saddle head of each of said perfume bottles.

* * * * *